US006138925A

United States Patent [19]

Anthony

[11] Patent Number: 6,138,925

[45] Date of Patent: Oct. 31, 2000

[54] TEXTURIZER DISPENSING APPARATUS

[75] Inventor: Michael M. Anthony, Parkland, Fla.

[73] Assignee: Eugene O'Neill, Ft. Lauderdale, Fla.

[21] Appl. No.: 09/192,413

[22] Filed: Nov. 16, 1998

[51] Int. Cl.[7] ..... B05B 3/10

[52] U.S. Cl. ..... 239/224; 239/231; 222/240; 222/241

[58] Field of Search ..... 239/214, 223, 239/224, 231, 263.1, 302, 7, 240, 264, 461, 498; 222/240, 241, 412; 401/137; 118/DIG. 16

[56] References Cited

U.S. PATENT DOCUMENTS 2,513,784 7/1950 Blomquist ..... 222/412
5,452,853 9/1995 Shook et al. ..... 239/7

*Primary Examiner*—Andres Kashnikow
*Assistant Examiner*—Lisa Ann Douglas
*Attorney, Agent, or Firm*—Oltman, Flynn & Kubler

[57] ABSTRACT

A dispensing apparatus for throwing discrete quantities of a viscous fluid material from a material source toward a target surface includes a housing having a material entry structure for connection to the material source, a material exit structure and a material passageway extending from the entry structure to the exit structure; a drive motor; a material pump powered by the drive motor for driving a stream of the material through the material passageway; and a centrifugal material throwing mechanism for accelerating segments of the material stream through the material exit structure toward the target surface. The material throwing mechanism preferably includes a direction adjustment mechanism for changing the exit trajectory of the accelerated segments of the material stream relative to the material exit structure.

14 Claims, 10 Drawing Sheets

TEXTURIZER DISPENSING APPARATUS

BACKGROUND OF THE INVENTION

1. Field of the Invention

The present invention relates generally to the field of material dispensing devices. More specifically the present invention relates to a dispensing apparatus for delivering viscous fluid materials such as grout in an airborne stream toward a target surface such as a building wall.

The apparatus includes a housing which has a material entry structure for connection to a material source in the form of either a container or a supply line, a material exit structure, an material passageway, pump means in the passageway powered by a drive motor for driving a stream of material through the passageway, and a centrifugal material throwing mechanism which accelerates segments of the material stream through the exit structure. The material throwing mechanism includes direction adjustment means for changing the exit trajectory of the accelerated segments of material relative to the exit structure.

2. Description of the Prior Art

There have long been devices for dispensing various types of viscous fluid materials for various purposes. One such device is the caulking gun which pumps a line of material onto a target surface in close proximity to the gun tip. A problem with the prior devices has been that none is suited to assist in grout texturizing by delivering grout in an airborne stream of clumps which can be aimed at the target surface.

It is thus an object of the present invention to provide a texturizer dispensing apparatus which dispenses an airborne stream of viscous fluid material for delivery onto a target surface.

It is another object of the present invention to provide such an apparatus which delivers grout or other viscous fluid material in a series of airborne clumps for ready texturizing with a trowel or other means.

It is still another object of the present invention to provide such an apparatus which is light and readily portable.

It is finally an object of the present invention to provide such an apparatus which is reliable and economical to manufacture.

SUMMARY OF THE INVENTION

The present invention accomplishes the above-stated objectives, as well as others, as may be determined by a fair reading and interpretation of the entire specification.

A dispensing apparatus for throwing discrete quantities of a viscous fluid material from a material source toward a target surface includes a housing having a material entry structure for connection to the material source, a material exit structure and a material passageway extending from the entry structure to the exit structure; a drive motor; a material pump powered by the drive motor for driving a stream of the material through the material passageway; and a centrifugal material throwing mechanism for accelerating segments of the material stream through the material exit structure toward the target surface.

The material throwing mechanism preferably includes a direction adjustment mechanism for changing the exit trajectory of the accelerated segments of the material stream relative to the material exit structure. The apparatus preferably additionally includes a gate valve within the material passageway between the material entry structure and the material throwing mechanism. The housing preferably includes an outer housing wall; and the material entry structure preferably includes an internally threaded coupling tube opening out of the housing wall. The exit structure preferably includes an opening adjacent to the material throwing mechanism having an outwardly projecting, outwardly widening funnel guide tube. The apparatus optionally additionally includes a pair of opposingly positioned right angle handle grips secured to the housing wall. The housing preferably includes a motor mounting opening and an adjacent motor mounting bracket, and the drive motor preferably includes a drive shaft and fastens onto the motor mounting bracket, so that the motor drive shaft extends into the housing through the motor mounting opening and includes a chuck.

The material throwing mechanism optionally includes a disk structure having a central opening and a radial slot having an open end and being in fluid communication with the central opening which receives a stream of the material through the opening and having a circumferential edge; a rotation shaft substantially perpendicular to and substantially concentric with the disk structure and drivably connected to the disk structure and to the motor drive shaft; and a spoke plate mounted to the rotation shaft at the disk structure center and extending diametrically across the disk structure to the disk structure circumferential edge, where the spoke plate is bent at a substantially right angle to extend across the circumferential edge of the disk structure and thereby form material throw tabs; and where the material throw tabs extend around and rotate about the disk structure circumferential edge to pass across the open end of the radial disk slot, so that the stream of material exiting from the open end of the radial slot is engaged by the material throw tabs in discrete quantities and accelerated along and outwardly from the disk structure circumferential edge toward and through the exit structure.

The rotation shaft optionally extends axially within a segment of the material stream passageway. The rotation shaft optionally includes a radial screw thread extending close to the passageway wall defining a flow screw pump mechanism for driving the material stream from the material source through the material passageway and to the material throwing mechanism.

The direction adjustment mechanism preferably includes a mechanism for rotating the radial slot to alter the position of the open end of the radial slot relative to the exit structure to adjust the direction of dispensing within the exit structure. The direction adjustment mechanism more specifically preferably includes a screw slot in the disk structure radially arched about the center of the disk structure midway between the disk structure center and the disk structure circumferential edge; and a set screw passing through the set screw slot into the housing; so that the disk structure is released to rotate about its center axis by loosening the set screw, and is tightened for apparatus operation by tightening the set screw to releasibly anchor the disk structure. The material source is optionally a container removably secured to the entry structure.

The material throwing mechanism alternatively includes an elongate throw plate mounted substantially at its center onto the rotation shaft, the throw plate including first and second plate segments extending in opposing directions from the rotation shaft, and a central plate opening, where the first plate segment contains a radial slot extending from the center of the throw plate and opening out of the outer end of the first plate segment, and where the second plate segment acts as a counterweight to the first plate segment, so that the throw plate rotates to centrifugally throw material within the radial slot radially outward to exit the exit structure in bursts as the radial slot open end passes the exit structure, and to thereby advance the stream of material within the material passageway to draw material out of the material entry structure and through the material passageway and through the central plate opening to throw the material radially outward through the rotating slot; and a circumferential housing wall portion extending around the rotational path of the throw plate opening at the material exit structure.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
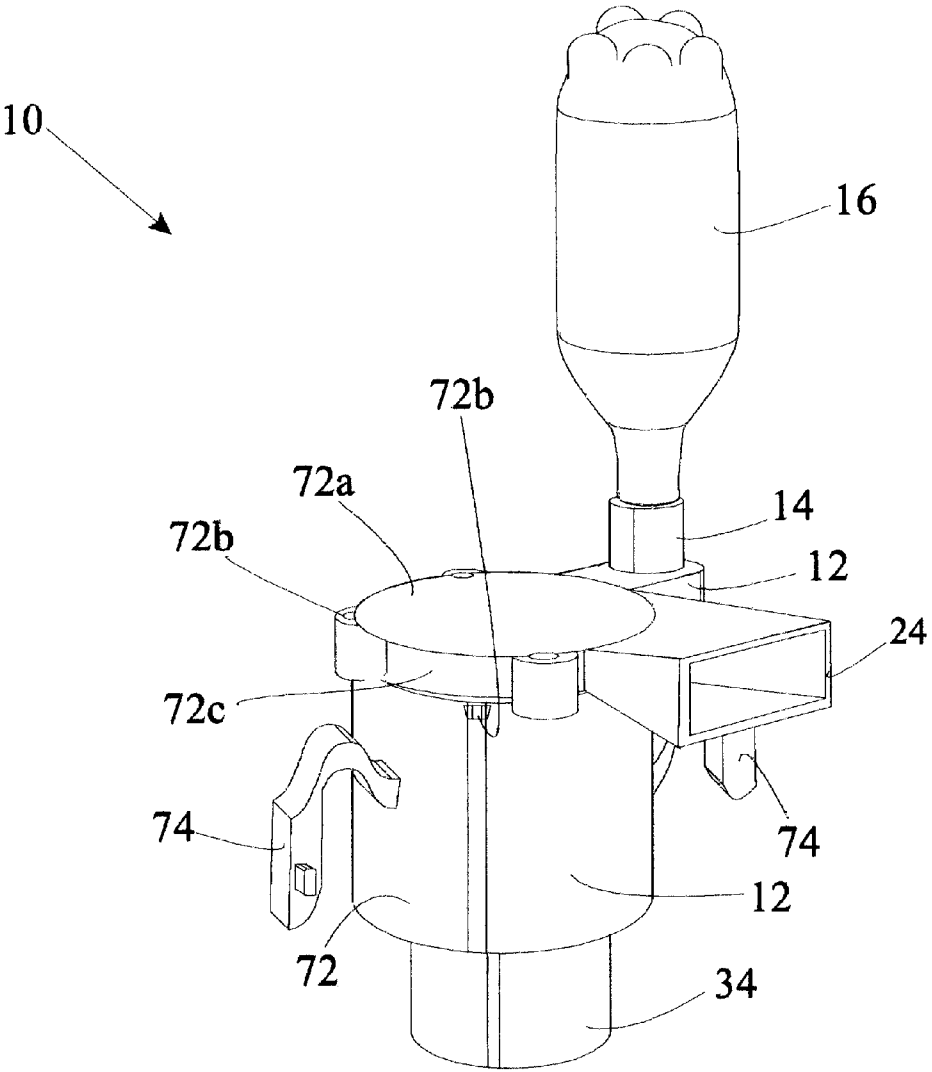
FIG. 1 is a perspective view of the first embodiment showing a material container screwed into the entry structure.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGS. are designated by the same reference numerals.

First Preferred Embodiment

Figure 2:
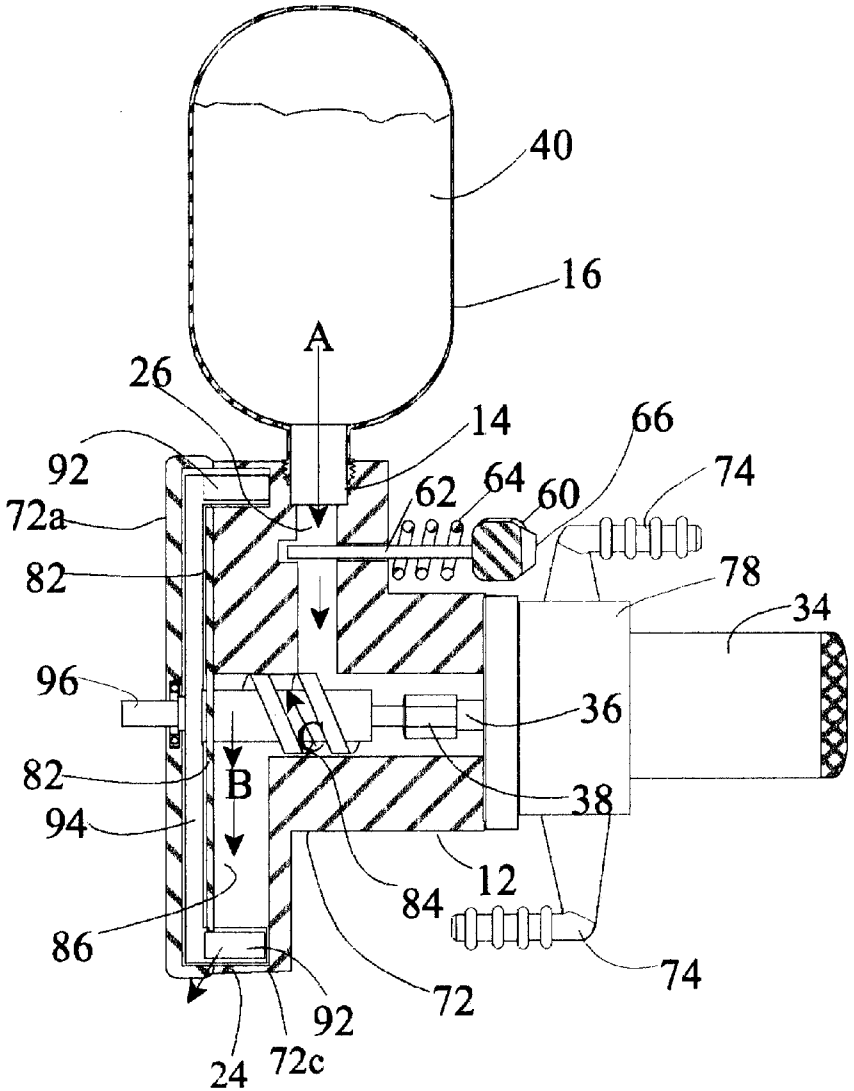
FIG. 2 is a cross-sectional side view of the apparatus of FIG. 1, showing the material advancing through the apparatus.
Figure 3:
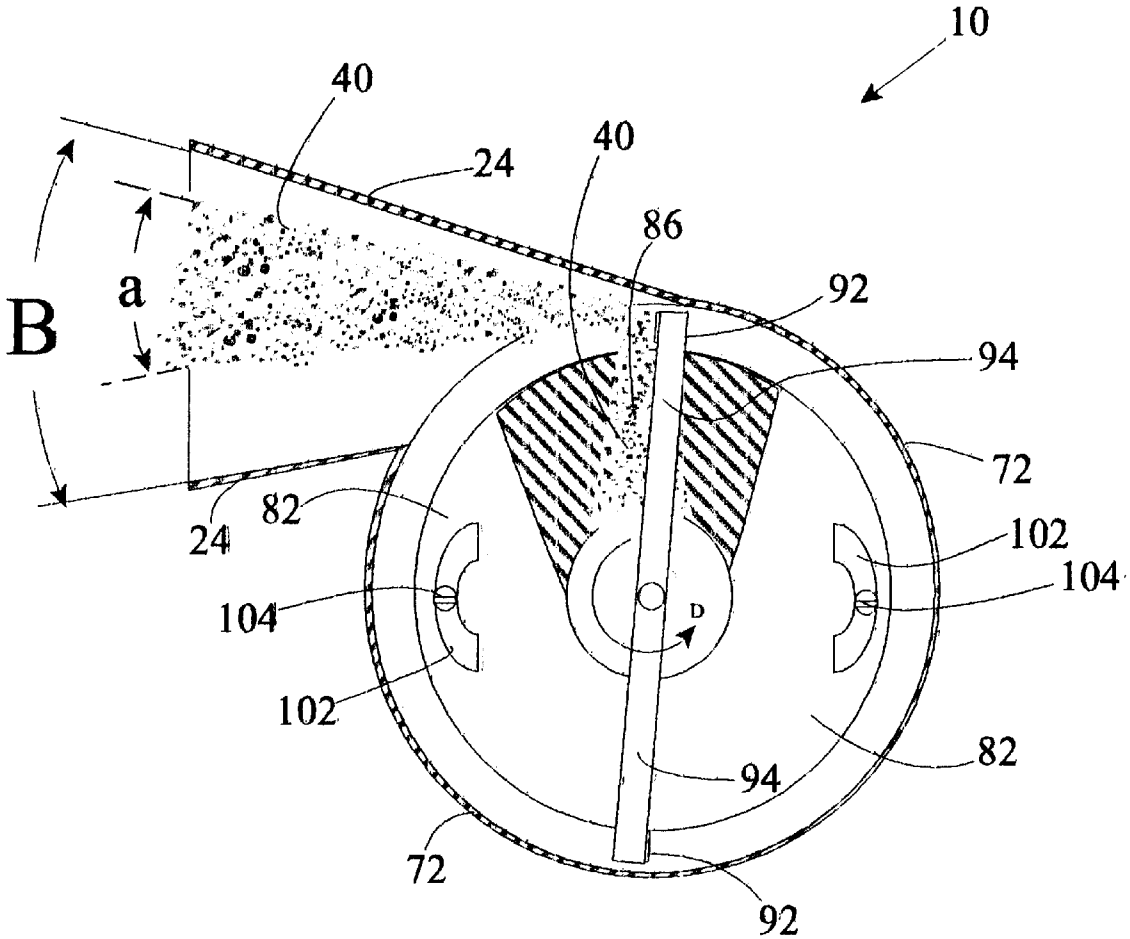
FIG. 3 is a cross-section through the housing at the disk structure, showing how the throw tabs accelerate material out through the exit structure.
Figure 4:
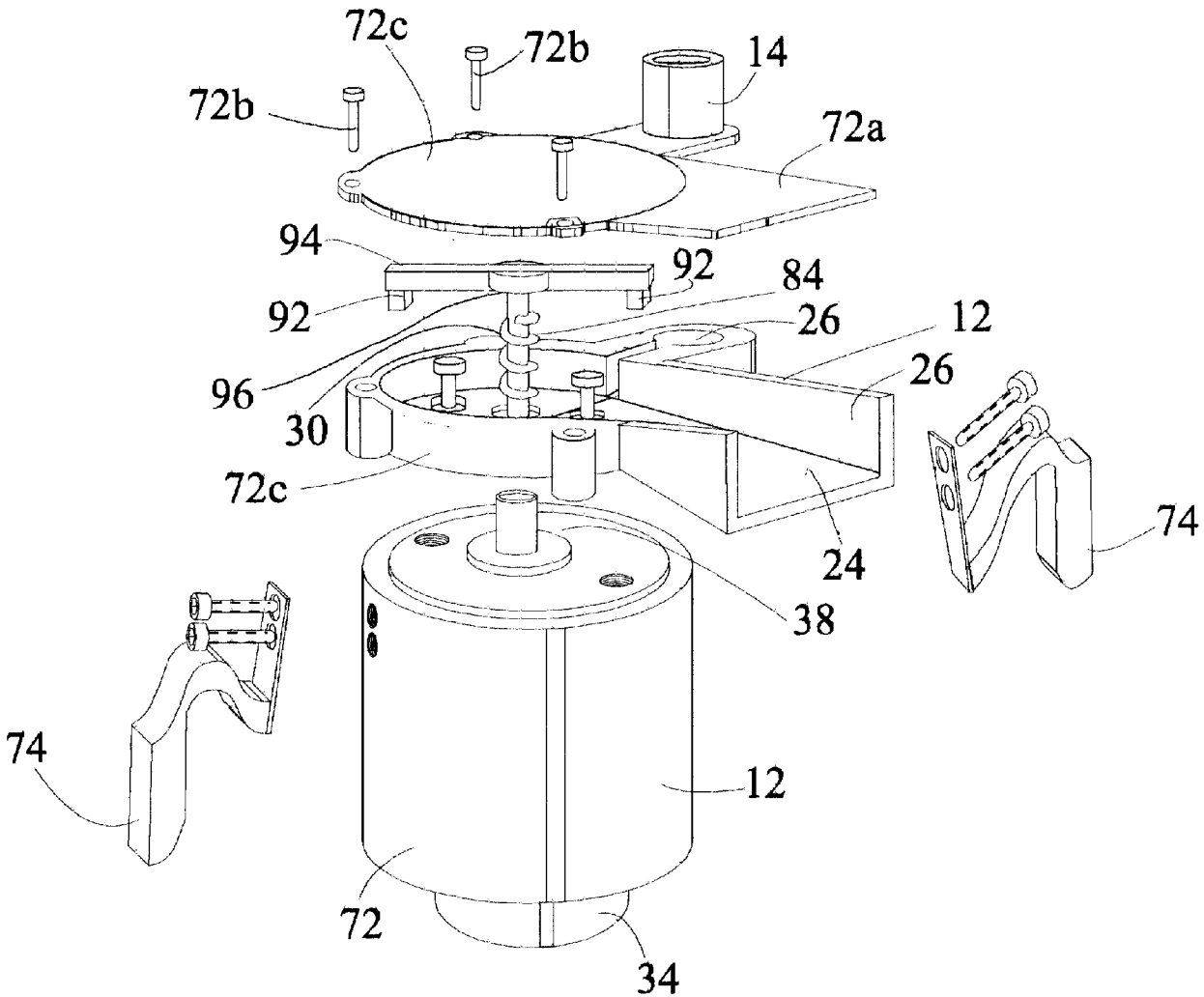
FIG. 4 is an exploded view of the apparatus of FIG. 1.
Figure 5:
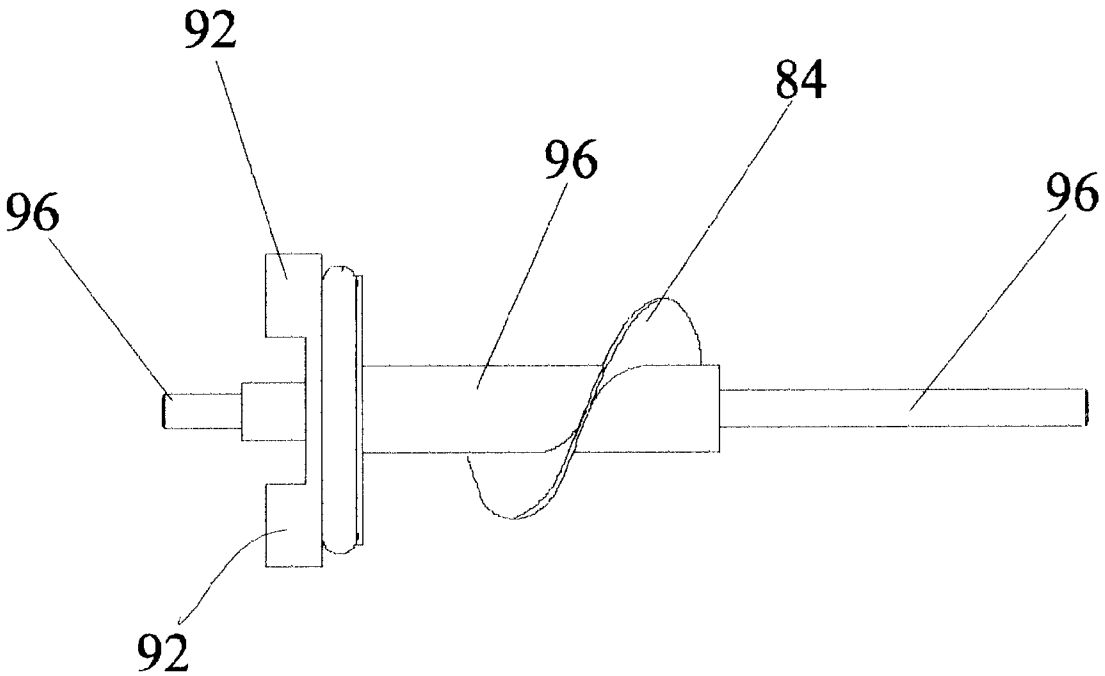
FIG. 5 is a side view of the rotation shaft with the material pumping threads and of the spoke plate, with an O-ring on the inward side of the spoke plate.
Figure 6:
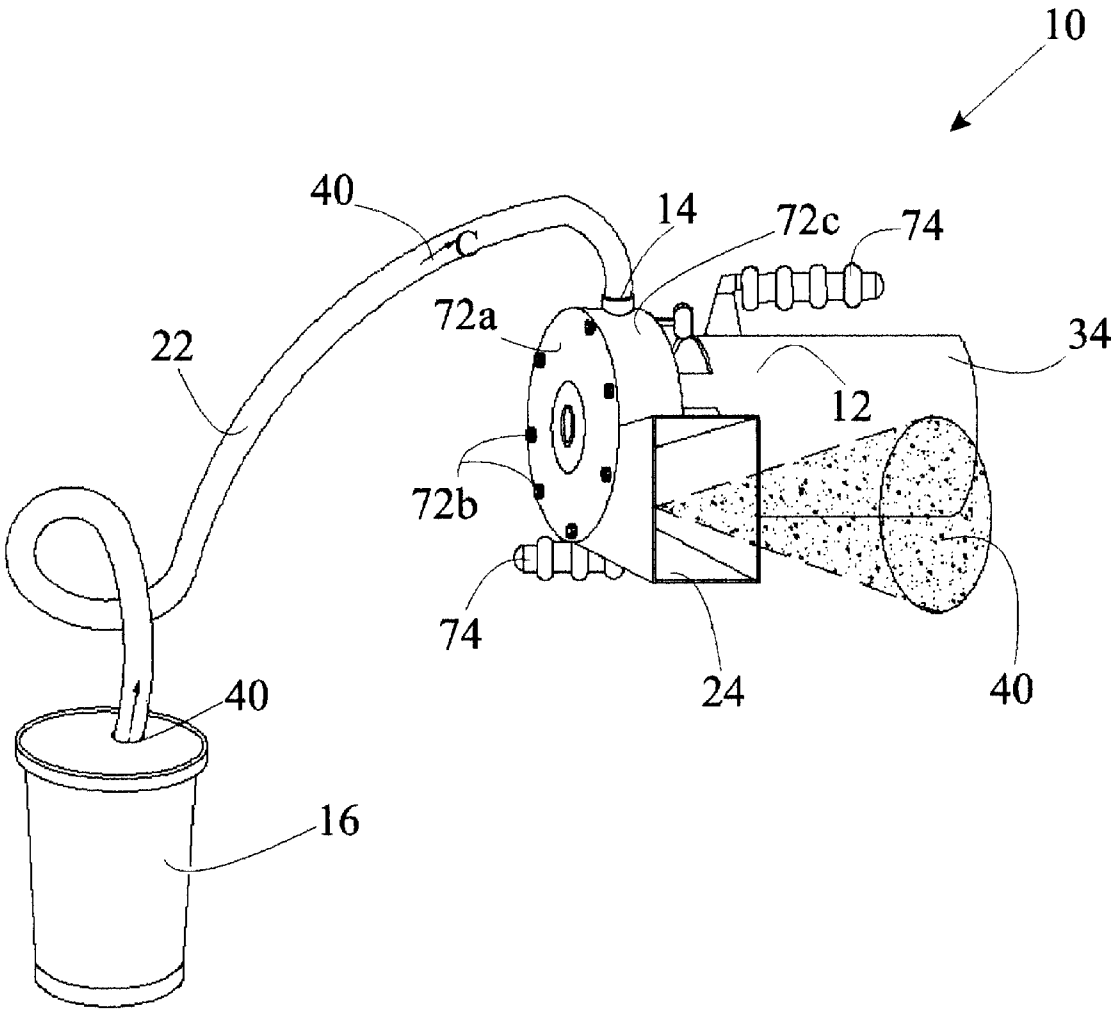
FIG. 6 is perspective view of the apparatus of FIG. 1, in which a material delivery tube carries material from a remote container to the apparatus entry structure.
Figure 7:
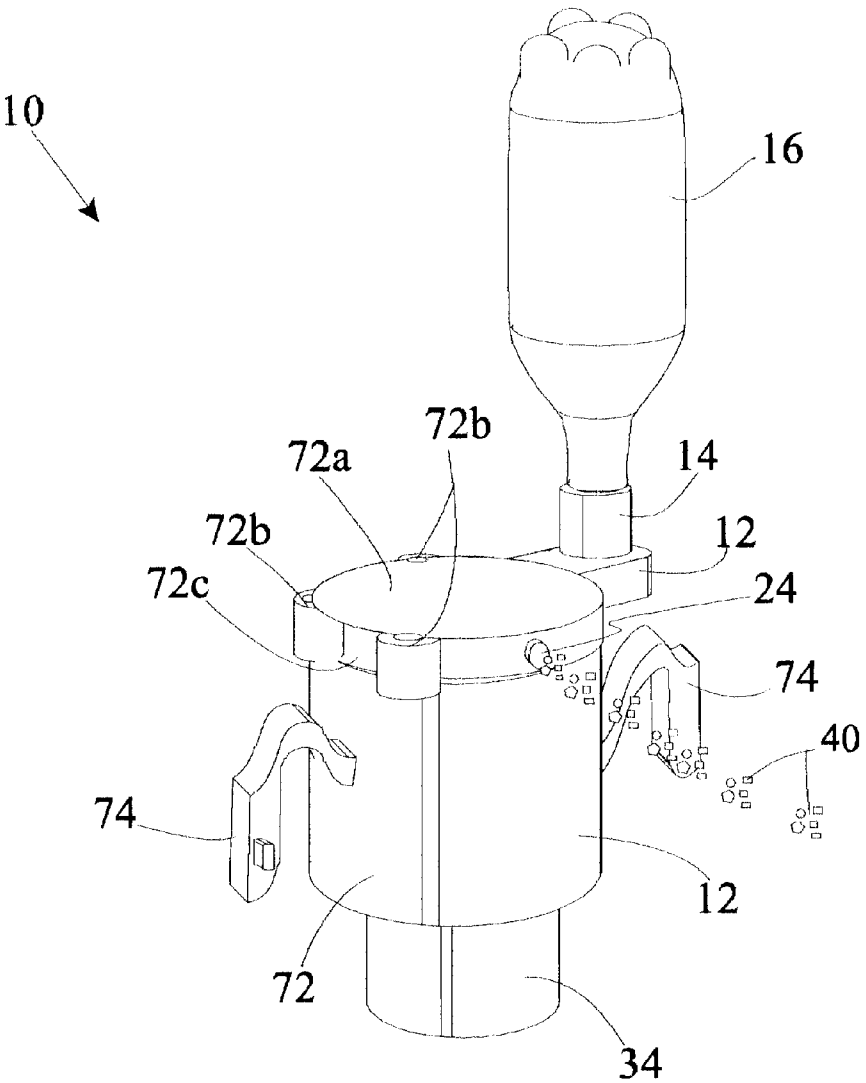
FIG. 7 is a perspective view of the apparatus of the second embodiment, with a material container screwed into the entry structure.
Figure 8:
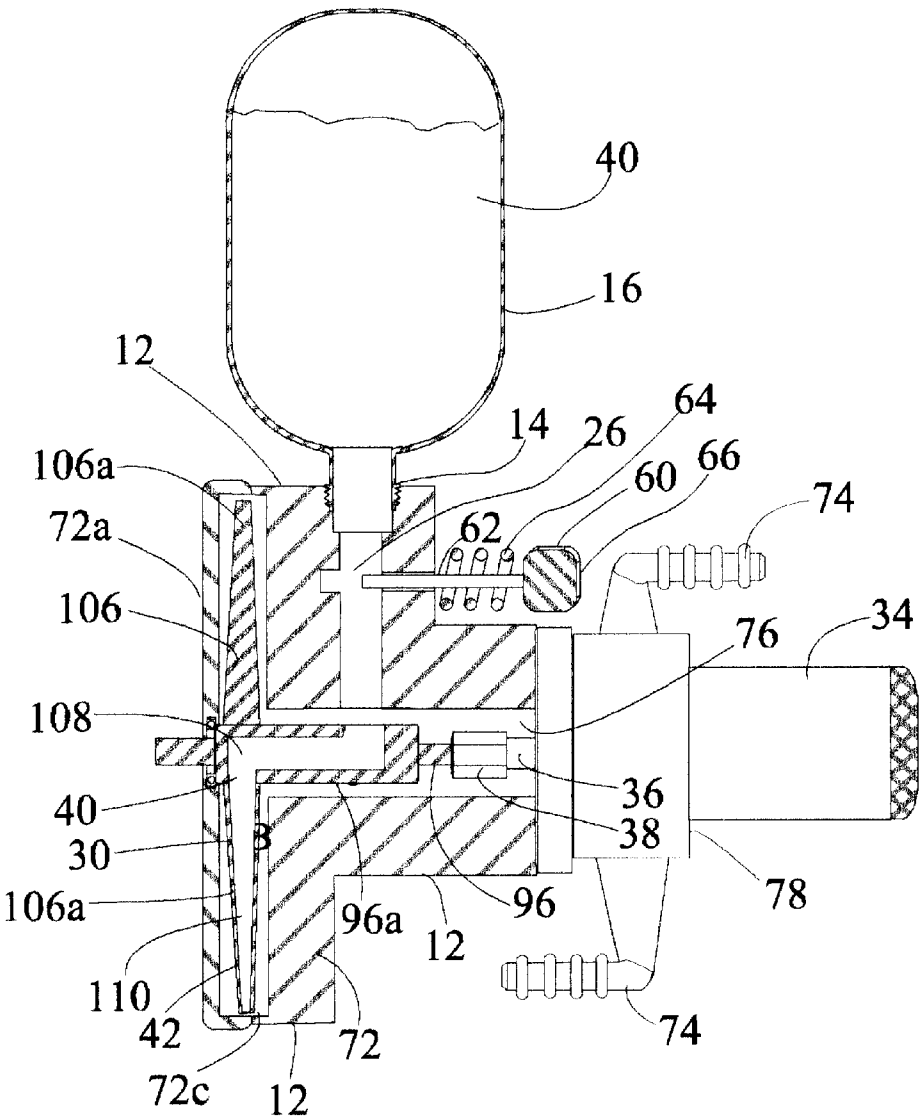
FIG. 8 is a cross-sectional side view of the apparatus of FIG. 7.
Figure 9:
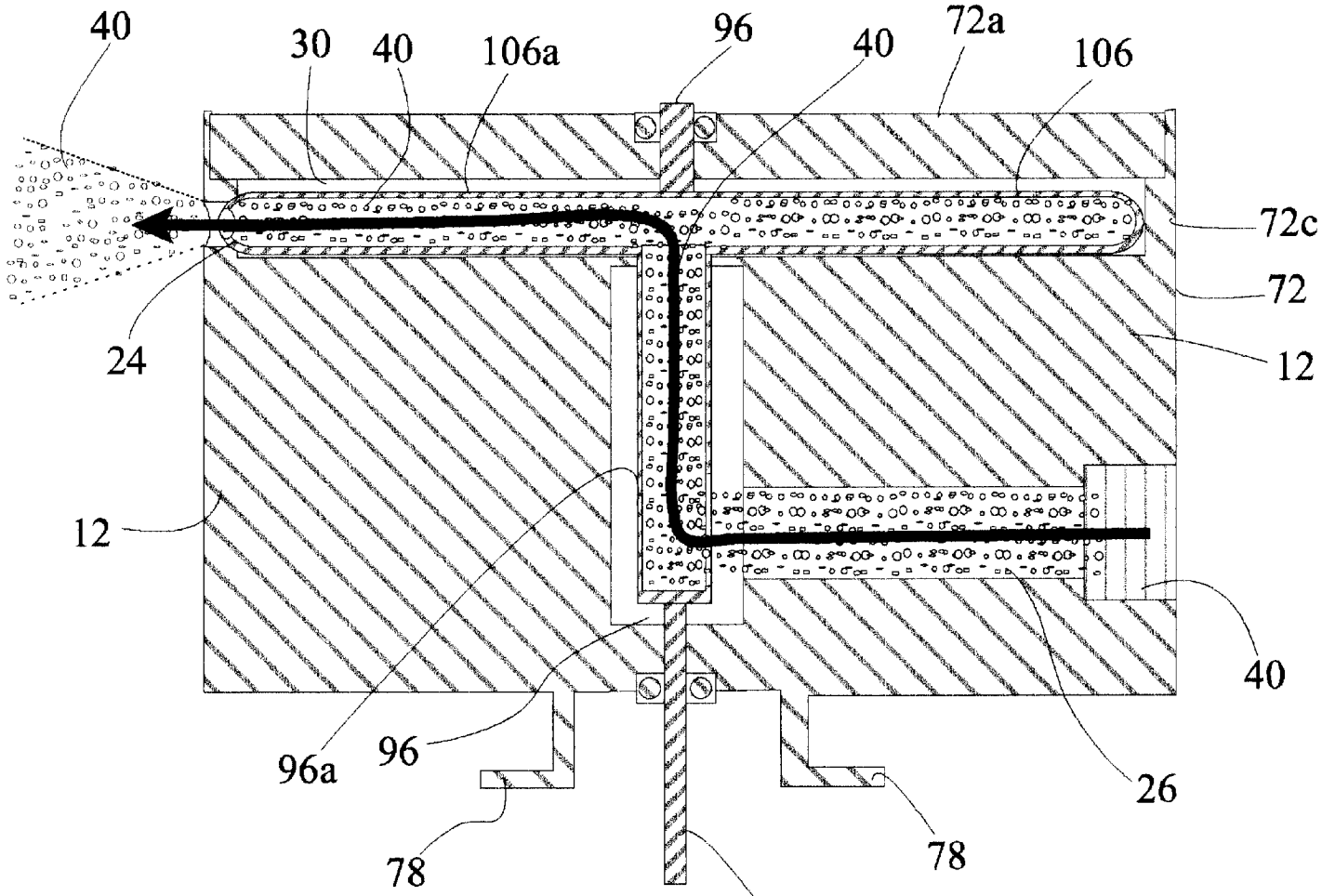
FIG. 9 is a cross-section of the apparatus housing taken longitudinally through the drive shaft, rotation shaft and throw plate, which in this instance are shown unified with the chuck omitted.
Figure 10:
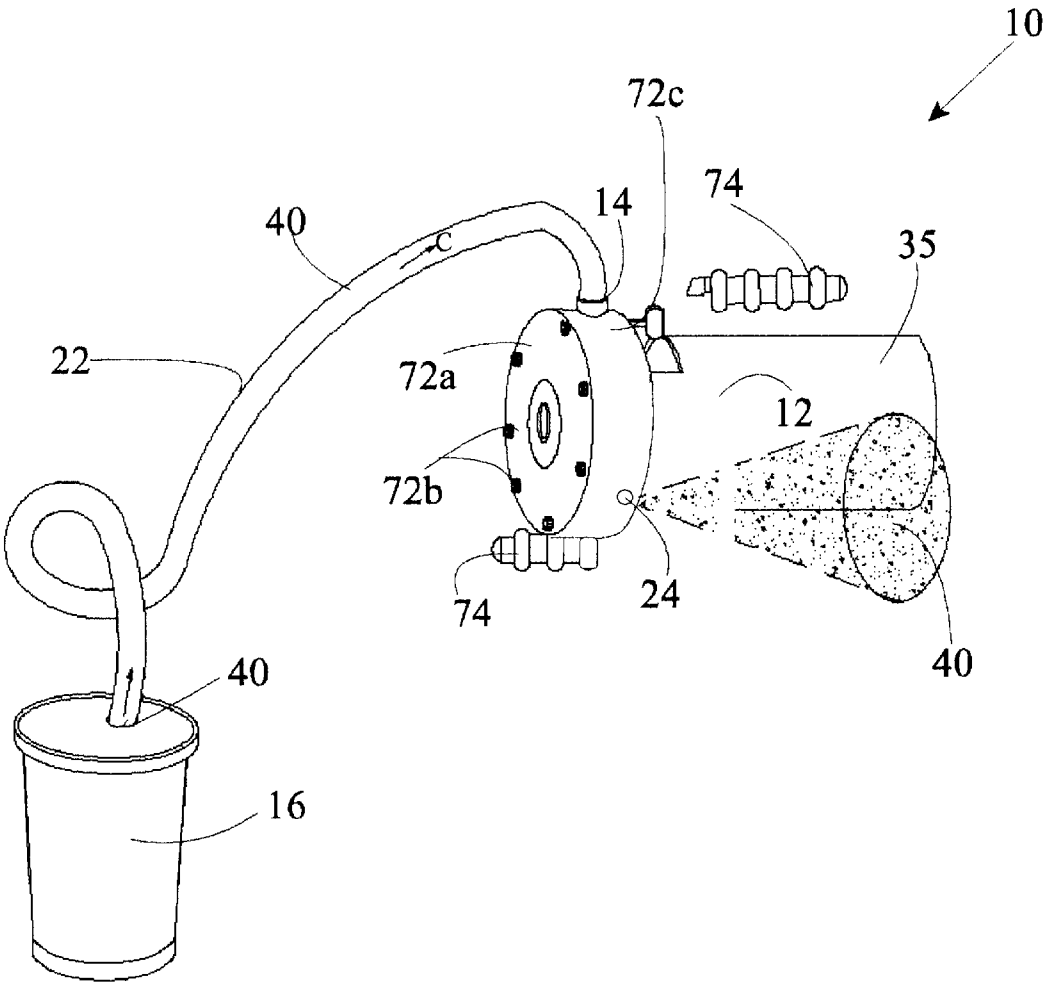
FIG. 10 is a perspective view of the apparatus of FIG. 7, in which a material delivery tube carries material from a remote container to the apparatus entry structure.

Referring to FIGS. 1–10, a dispensing apparatus 10 is disclosed including a housing 12 which has a material entry structure 14 for connection to a material source, in the form of either a material container 16 or a supply line 22, a material exit structure 24, an internal material passageway 26, and a pump mechanism 30 powered by a drive motor 34 for driving a stream of material 40 through passageway 26, the pump mechanism 30 including a centrifugal material throwing mechanism 42 which accelerates segments of the stream of material 40 out through material exit structure 24. Material throwing mechanism 42 includes a direction adjustment mechanism 50 for changing the exit trajectory of accelerated segments of material 40 relative to exit structure 24. A hand-operated gate valve 60 with a gate rod 62 surrounded by a coil spring 64 and having a finger pull knob 66 is preferably provided in passageway 26 between entry structure 14 and throwing mechanism 42. A solenoid operated valve (not shown) is alternatively contemplated.

Housing 12 includes an outer housing wall 72, and entry structure 14 takes the form of an internally threaded coupling tube opening out of housing wall 72. Exit structure 24 takes the form of an opening adjacent to material throwing mechanism 42 having an outwardly projecting, outwardly widening funnel guide tube. A pair of opposingly oriented right angle handle grips 74 are preferably provided on housing 12. A motor mounting opening 76 surrounded by a motor mounting bracket 78 is provided. Drive motor 34 is a conventional electric motor 34 having a drive shaft 36 which bolts onto bracket 78, so that drive shaft 36 extends into housing 12 through mounting opening 76. A chuck is provided on the drive shaft 36 free end.

For one embodiment the material throwing mechanism 42 includes a guide disk structure 82 which receives a stream of material adjacent to its center, the material being delivered by a pump mechanism 30 flow screw 84 from entry structure 14, and directs it radially outward through a disk radial slot 86. Throw tabs 92 are mounted to rotate about the axis of the disk structure 82 and extend around the circumferential edge of disk structure 82, to pass across the disk radial slot 86 open end. The stream of material exiting radial slot 86 is engaged by the throw tabs 92 in discrete quantities or segments and accelerated circumferentially along the disk structure 82 edge, while centrifugal forces simultaneously accelerate the material radially outward toward and through exit structure 24. Clumps of the material are thus thrown in rapid sequence out of exit structure 24. These clumps might be lumps of grout material impacting a wall for subsequent texturized spreading with a trowel. Flow screw 84 is powered either by electric drive motor 34 attached to housing 12 or some other means, such as a compressed air drive motor (not shown) connected to an air source.

The throw tabs 92 are preferably part of a single elongate spoke plate 94 mounted to a rotation shaft 96 at the disk structure 82 axis and extending diametrically across disk structure 82 to its edges, where the plate 94 bends at a right angle to extend across the disk structure 82 circumferential edge and thereby form tabs 92. The rotation shaft 96 is preferably mounted to motor drive shaft chuck 38, and extends axially along the segment of the material stream passageway 26 which feeds into disk structure 82. Rotation shaft 96 includes a broad radial screw thread which defines flow screw 84 and extends close to the passageway 26 wall for driving the material stream from the material source 16 or 22 through passageway 26 and through material throwing mechanism 42.

Direction adjustment mechanism 50 adjusts the direction of dispensing within exit structure 24 by orientating radial slot 86 relative to exit structure 24. Access to direction adjustment mechanism 50 is provided by a removable housing wall panel 72*a* which extends over disk structure 82 and is removably fastened to the remainder of housing wall 72 with wall panel bolts 72*b*. Disk structure 82 includes radially arched set screw slots 102 midway between the disk center and its circumferential edge, and a set screw 104 passing through each set screw slot 102 into the housing 12. Set screws 104 are loosened to release disk structure 82 to rotate a few degrees about its axis, and then are tightened to releasibly anchor disk structure 82 relative to exit structure 24.

Second Preferred Embodiment

For a second embodiment, the material throwing mechanism 42 includes an elongate throw plate 106 mounted at its center onto rotation shaft 96 in place of disk structure 82. See FIGS. 7–10. Throw plate 106 includes a center opening 108 and a first plate segment 106*a* containing a radial slot 110 extending from the plate 106 center and opening at the circumferential end of the first plate segment 106*a*. An opposing second plate segment 106*b* acts as a counterweight, and may also contain a radial slot 110. Rotation shaft 96 has a tubular segment 96*a* which opens laterally adjacent to radial slot 110 to be in fluid communication with slot 110, and which opens laterally adjacent to receive material 40 from passageway 26.

Throw plate 106 rotates to draw material out of the entry structure 14 and passageway 26 through the center opening 108 and to throw the material radially outward through the rotating radial slot 110. Radial slot 110 extends to very close proximity to a circumferential housing wall portion 72*c*, so that the housing wall 72 closes the end of the slot 110 against material discharge. Exit structure 24 is a discharge port in the housing circumferential wall portion 72*c* through which a segment of the material stream is released centrifugally each time radial slot 110 passes the discharge port. Since the rotating throw plate 106 provides the centrifugal force to move the stream of material through passageway 26, and also to throw the material outwardly through exit structure 24 in discrete segments, the tabs 92 and flow screw 84 thread of the first embodiment are unnecessary and are omitted.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

PARTS LIST

10. Apparatus
12. Housing
14. Entry structure
16. Material container
22. Material supply line
24. Exit structure
26. Material passageway
30. Pump mechanism
34. Drive motor
36. Drive shaft
38. Chuck
40. Material
42. Throwing mechanism
50. Direction adjustment mechanism
60. Gate valve
62. Gate rod
64. Coil spring
66. Pull knob
72. Housing wall
72*a*. Housing wall panel (removable)
72*b*. Wall panel bolts
72*c*. Circumferential housing wall portion
74. Handle grips
76. Motor mounting opening
78. Motor mounting bracket
82. Guide disk structure
84. Flow screw
86. Disk radial slot
92. Throw tabs
94. Elongate spoke plate
96. Rotation shaft
96*a*. Tubular portion of shaft 96
102. Radially arched set screw slots
104. Set screws

Second Embodiment

106. Throw plate
106*a*. First plate segment (has radial slot)
106*b*. Second plate segment
108. Plate center opening
110. Radial slot

I claim as my invention:

1. A dispensing apparatus for throwing discrete quantities of a viscous fluid material from a material source toward a target surface, comprising:

a housing having a material entry structure for connection to the material source, a material exit structure and a material passageway extending from said entry structure to said exit structure;

a drive motor;

material pump means powered by said drive motor for driving a stream of the material through said material passageway;

and a centrifugal material throwing mechanism comprising means for accelerating segments of the material stream within and relative to said housing and subsequently through said material exit structure toward said target surface.

2. An apparatus according to claim 1, wherein said housing comprises:

an outer housing wall;

and wherein said material entry structure includes an internally threaded coupling tube opening out of said housing wall.

3. A dispensing apparatus for throwing discrete quantities of a viscous fluid material from a material source toward a target surface, comprising:

a housing having a material entry structure for connection to the material source, a material exit structure and a material passageway extending from said entry structure to said exit structure;

a drive motor;

material pump means powered by said drive motor for driving a stream of the material through said material passageway;

a centrifugal material throwing mechanism for accelerating segments of the material stream through said material exit structure toward said target surface;

and a gate valve within said material passageway between said material entry structure and said material throwing mechanism.

4. A dispensing apparatus for throwing discrete quantities of a viscous fluid material from a material source toward a target surface, comprising:

a housing having a material entry structure for connection to the material source, a material exit structure and a material passageway extending from said entry structure to said exit structure;

a drive motor;

material pump means powered by said drive motor for driving a stream of the material through said material passageway;

a centrifugal material throwing mechanism for accelerating segments of the material stream through said material exit structure toward said target surface;

wherein said material throwing mechanism comprises:

direction adjustment means for changing the exit trajectory of the accelerated segments of the material stream relative to said material exit structure.

5. A dispensing apparatus for throwing discrete quantities of a viscous fluid material from a material source toward a target surface, comprising:

a housing having a material entry structure for connection to the material source, a material exit structure and a material passageway extending from said entry structure to said exit structure, said housing comprising an outer housing wall; and wherein said material entry structure includes an internally threaded coupling tube opening out of said housing wall;

a drive motor;

material pump means powered by said drive motor for driving a stream of the material through said material passageway;

and a centrifugal material throwing mechanism for accelerating segments of the material stream through said material exit structure toward said target surface;

wherein said exit structure includes an opening adjacent to said material throwing mechanism having an outwardly projecting, outwardly widening funnel guide tube.

6. A dispensing apparatus for throwing discrete quantities of a viscous fluid material from a material source toward a target surface, comprising:

a housing having a material entry structure for connection to the material source, a material exit structure and a material passageway extending from said entry structure to said exit structure, said housing comprising an outer housing wall; and wherein said material entry structure includes an internally threaded coupling tube opening out of said housing wall;

a drive motor;

material pump means powered by said drive motor for driving a stream of the material through said material passageway;

a centrifugal material throwing mechanism for accelerating segments of the material stream through said material exit structure toward said target surface;

and a pair of opposingly positioned right angle handle grips secured to said housing wall.

7. A dispensing apparatus for throwing discrete quantities of a viscous fluid material from a material source toward a target surface, comprising:

a housing having a material entry structure for connection to the material source, a material exit structure and a material passageway extending from said entry structure to said exit structure, said housing comprising an outer housing wall; and wherein said material entry structure includes an internally threaded coupling tube opening out of said housing wall;

a drive motor;

material pump means powered by said drive motor for driving a stream of the material through said material passageway;

a centrifugal material throwing mechanism for accelerating segments of the material stream through said material exit structure toward said target surface;

wherein said housing comprises a motor mounting opening and an adjacent motor mounting bracket, and wherein said drive motor includes a drive shaft and wherein said drive motor fastens onto said motor mounting bracket, such that said motor drive shaft extends into said housing through said motor mounting opening and includes a chuck.

8. A dispensing apparatus for throwing discrete quantities of a viscous fluid material from a material source toward a target surface, comprising:

a housing having a material entry structure for connection to the material source, a material exit structure and a material passageway extending from said entry structure to said exit structure, said housing comprising an outer housing wall; and wherein said material entry structure includes an internally threaded coupling tube opening out of said housing wall;

a drive motor;

material pump means powered by said drive motor for driving a stream of the material through said material passageway;

a centrifugal material throwing mechanism for accelerating segments of the material stream through said material exit structure toward said target surface;

wherein said drive motor comprises a motor drive shaft and wherein said material throwing mechanism comprises:

a disk structure having a central opening and a radial slot having an open end and being in fluid communication with said central opening which receives a stream of the material through said opening and having a circumferential edge;

a rotation shaft substantially perpendicular to and substantially concentric with said disk structure and drivably connected to said disk structure and to said motor drive shaft;

and a spoke plate mounted to said rotation shaft at the disk structure center and extending diametrically across the disk structure to the disk structure circumferential edge, wherein said spoke plate is bent at a substantially right angle to extend across the circumferential edge of said disk structure and thereby form material throw tabs;

wherein said material throw tabs extend around and rotate about the disk structure circumferential edge to pass across the open end of said radial disk slot, such that the stream of material exiting from the open end of said radial slot is engaged by said material throw tabs in discrete quantities and accelerated along and outwardly from the disk structure circumferential edge toward and through said exit structure.

9. An apparatus according to claim 8, wherein said rotation shaft extends axially within a segment of said material stream passageway.

10. An apparatus according to claim 9, wherein said rotation shaft comprises a radial screw thread extending close to the passageway wall defining flow screw pump means for driving the material stream from the material source through said material passageway and to said material throwing mechanism.

11. An apparatus according to claim 4, wherein said direction adjustment mechanism comprises means for rotating said radial slot to alter the position of the open end of the radial slot relative to the exit structure to adjust the direction of dispensing within said exit structure.

12. An apparatus according to claim 4, wherein said direction adjustment mechanism comprises:

a screw slot in said disk structure radially arched about the center of said disk structure midway between the disk structure center and the disk structure circumferential edge;

and a set screw passing through said set screw slot into said housing;

such that said disk structure is released to rotate about its center axis by loosening said set screw, and is tightened for apparatus operation by tightening said set screw to releasibly anchor said disk structure.

13. A dispensing apparatus for throwing discrete quantities of a viscous fluid material from a material source toward a target surface, comprising:

a housing having a material entry structure for connection to the material source, a material exit structure and a material passageway extending from said entry structure to said exit structure;

a drive motor;

material pump means powered by said drive motor for driving a stream of the material through said material passageway;

a centrifugal material throwing mechanism for accelerating segments of the material stream through said material exit structure toward said target surface;

wherein said material source is a container removably secured to said entry structure.

14. An apparatus according to claim 11, wherein said material throwing mechanism comprises:

an elongate throw plate mounted substantially at its center onto said rotation shaft, said throw plate comprising first and second plate segments extending in opposing directions from said rotation shaft, and a central plate opening, wherein said first plate segment contains a radial slot extending from the center of said throw plate and opening out of the outer end of said first plate segment, and wherein said second plate segment acts as a counterweight to the first plate segment, such that said throw plate rotates to centrifugally throw material within said radial slot radially outward to exit said exit structure in bursts as said radial slot open end passes said exit structure, and to thereby advance said stream of material within said material passageway to draw material out of said material entry structure and through said material passageway and through the central plate opening to throw the material radially outward through the rotating slot;

and a circumferential housing wall portion extending around the rotational path of said throw plate opening at said material exit structure.

* * * * *